US011576448B2

(12) United States Patent
White et al.

(10) Patent No.: US 11,576,448 B2
(45) Date of Patent: Feb. 14, 2023

(54) METHOD AND APPARATUS FOR COMFORTABLY RETAINING MASK OVER A HUMAN'S FACE

(71) Applicant: Swivler, Inc., Woodland, WA (US)

(72) Inventors: Rick White, Woodland, WA (US); Bradley White, Vancouver, WA (US); Brandon White, Vancouver, WA (US); Yana Chumov, Ridgefield, WA (US)

(73) Assignee: Swivler, Inc., Woodland, WA (US)

( * ) Notice: Subject to any disclaimer, the term of this patent is extended or adjusted under 35 U.S.C. 154(b) by 256 days.

(21) Appl. No.: 16/913,078

(22) Filed: Jun. 26, 2020

(65) Prior Publication Data

US 2021/0401081 A1 Dec. 30, 2021

(51) Int. Cl.
*A41D 13/11* (2006.01)

(52) U.S. Cl.
CPC ..... *A41D 13/1161* (2013.01)

(58) Field of Classification Search
CPC .. A41D 13/1161; A41D 13/11; A62B 18/084; A44B 11/2569
USPC ..... 2/9
See application file for complete search history.

(56) References Cited

U.S. PATENT DOCUMENTS

2010/0224199 A1* 9/2010 Smith ..... A61M 16/06 128/863
2015/0053206 A1* 2/2015 Seppala ..... A62B 18/10 128/206.17
2020/0093212 A1* 3/2020 Zheng ..... A41D 13/1161
2020/0406071 A1* 12/2020 Park ..... A62B 23/02

OTHER PUBLICATIONS

"Silicone Mask Strap Extender with Buttons", https://www.amazon.com/Silicone-Adjustable-Anti-Slip-Anti-Tightening-Protector/dp/B08BRJZYLR?th=1, published Jun. 24, 2020.
MProkuda Origami, "How to Make a Holder for a Medical Mask", https://www.youtube.com/watch?v=FS_31P9QuwM, published Apr. 8, 2020.
Mask Holder with Butttons, https://knittingpattern.org/mask-strap-holder-free-crochet-patterns/, published at least as early as May 27, 2020.
Nanay Express, "DIY Headband with Facemask Holder No Sewing Machine", https://www.youtube.com/watch?v=b-bEB5pmNeM, published Mar. 31, 2020.
"Mask Strap Extender with 3 Buttons", https://www.aliexpress.com/i/4000903145398.html, published at least as early as May 27, 2020.

* cited by examiner

*Primary Examiner* — Timothy K Trieu
(74) *Attorney, Agent, or Firm* — Emerson, Thomson & Bennett, LLC; Roger D. Emerson; Peter R. Detorre

(57) ABSTRACT

An article and method for using the same is disclosed. The article is worn on a user's head and secures a mask to the user's face without requiring loops associated with the mask to be worn over the back of the ears of the user, thereby eliminating strain and discomfort on the user's ears.

5 Claims, 8 Drawing Sheets

METHOD AND APPARATUS FOR COMFORTABLY RETAINING MASK OVER A HUMAN'S FACE

The present invention relates generally to the art of masks such is used by medical personnel, or all people, in the case of a pandemic, such as Covid-19, and more specifically, to a reusable apparatus that makes using a mask more comfortable. This is of special benefit to those who wear a mask for hours each day.

BACKGROUND OF THE INVENTION

1. Field of the Invention

It is known to provide masks for humans to limit the spread of disease. It is also know to attach the masks removably to the face and head of a human wearer, by providing loops that are positioned behind the wearers ears, and thereby securing the mask over the human's mouth and nose. However, when a mask is worn for a long period of time, it is not uncommon for the back of the ear to become irritated by the stress and irritation provided by the loops of the mask.

Different solutions to this problem have been offered. Nonetheless, certain advantages and benefits are afforded by the present design, which will be described and detailed following.

SUMMARY OF THE INVENTION

With reference to FIG. 7, a back view of the article 10 is shown in place, worn by an associated user 66. Note how well the article 10 conforms to the generally spherical shape of the associated user's 66 head 82. Further note this user has the left associated loop 74 of the associated mask 70 operatively connected to extensions 42, 44, and the user has the associated right loop 76 looped over the extensions 52, 54.

With continued reference to FIGS. 1 through 4, a first reinforcing member 90 is operatively connected between extensions 42, 44, while a parallel second reinforcing member 92 is positioned operatively between extensions 52, 54. The reinforcing members 90, 92 help strengthen the structural stability of the article 10.

The foregoing, as well as other objectives and features will become apparent to those skilled in the art of restoration of anterior teeth from a reading of the following detailed description, taken in conjunction with the accompanying drawings, wherein:

DETAILED DESCRIPTION OF A PREFERRED EMBODIMENT

Figure 3:
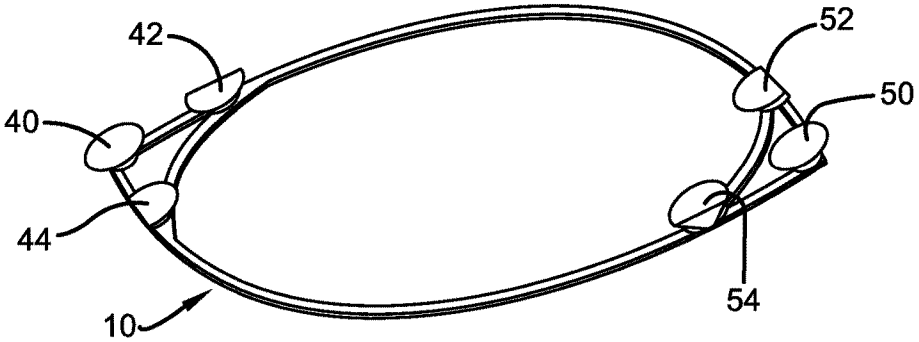
FIG. 3 is a side perspective view of the article 10.
Figure 4:
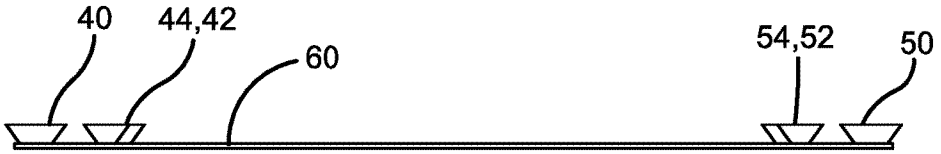
FIG. 4 is a side view of the article 10 shown in FIG. 1.
Figure 2:
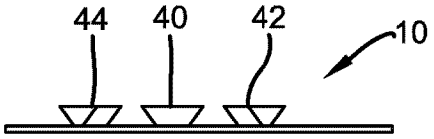
FIG. 2 is an end view of the article 10 shown in FIG. 1.
Figure 1:
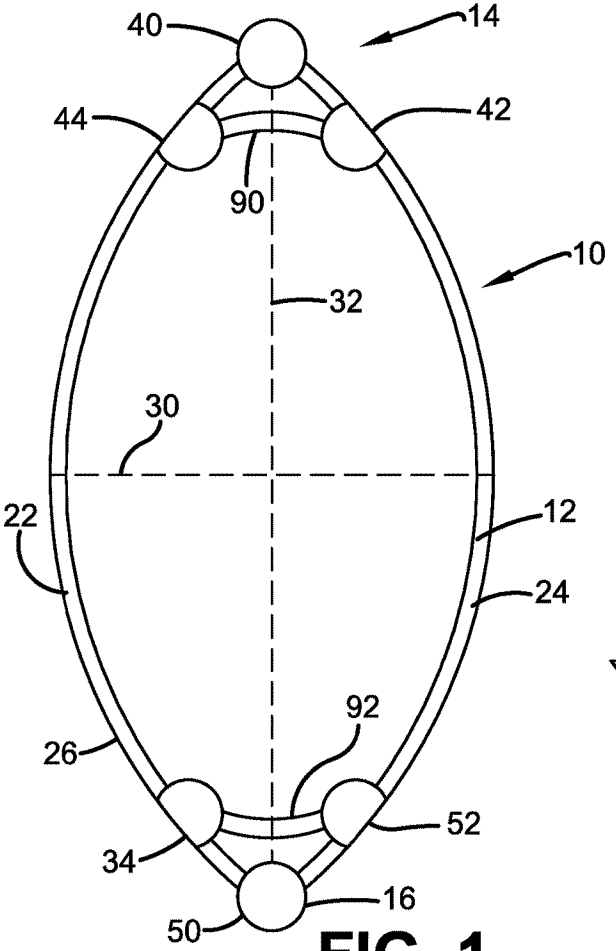
FIG. 1 is a top view of an article 10 showing the top surface of the article.

With reference now to the drawings, FIGS. 1 through 4 illustrate the inventive article. Namely, the article 10 features a top view as shown in FIG. 1 and a bottom perspective view as shown in FIG. 3. A side view of the article as illustrated in FIG. 3 is shown in FIG. 4, while an end view of the article as shown in FIG. 1*s* shown in FIG. 2. The article comprises a frame 12 which is essentially oval-shaped, or football shaped in that it has a first end 14 and a second end 16, which are essentially disposed from each other. The distance between the first end 14 and the second end 16 is greater than the distance between a first midpoint 20 of the first arc 24, and a second midpoint 22 of the second arc 26.

Stated another way, the first, or vertical center line 30 is a shorter distance than the second, or horizontal center line 32. In the preferred embodiment, the vertical center line 30 is 106.6 millimeters, while the horizontal center line 32 is 212.1 millimeters. It is believed that other, but similar, ratios between the vertical and horizontal centerline can work. For example, the vertical axis can be between 80 millimeters and 125 millimeters long, with the preferred length being 106.6 millimeters; said horizontal axis can be between 180 millimeters and 300 millimeters long, with the preferred length being 212.1 millimeters; a ratio of said vertical axis to said horizontal axis is preferably between 45% and 55%, with the preferred ratio being 50%.

The article 10 can be manufactured according to any method and of any material chosen with sound engineering and materials judgment, but the preferred manufacturing method is injection molding or transfer molding and the preferred material is plastic. The article 10 can also be successfully made with a 3D printer.

With continuing reference to FIGS. 1 through 4, both the first end 14 of the article 10 and the second end 16 of the article 10 feature extensions. With continued reference to FIGS. 1 through 4, the extensions 40, 42, 44, 50, 52, 54 extend outwardly from a top or outward surface 60 of the article 10. With special reference to FIGS. 1 and 3, extensions 42, 44, 52, 54, which lie toward the center of the article 10 have their round top surfaces truncated so as to better match the outer periphery of the article 10. However, extensions 40, 50, which are located at the first end 14 and the second end 16 of the article 10, respectively, have a top surface that is fully round.

With reference now to FIGS. 5 through 9, the operation of the article 10 will be described and some of its features will be highlighted. With general reference to FIGS. 5 through 9, the article 10 is shown as intended to be worn by an associated user 66. With continued reference to FIGS. 5 through 9, note that the associated user 66 is shown wearing an associated mask 70. The associated mask 70 includes an associated loop 74, which fits over the associated user's 66 associated ear 78. Before the invention of the inventive article 10, the associated loop 74 would fit behind the associated ear 78 and would provide the necessary tension to hold the associated mask 70 against the associated user's 66 mouth and nose (not shown). However, by use of the inventive article 10, the associated loop 74 can be placed around the extension 40, thereby securely holding the associated mask 70 against the associated user's 66 nose and mouth while eliminating the strain on the associated user's 66 associated ear 78. Note how the shape of the article 10 corresponds to the back of the associated user's 55 head 82. The oval, or football shape of the article 10 corresponds effectively to the shape of the back of the user's head 82.

Figure 5:
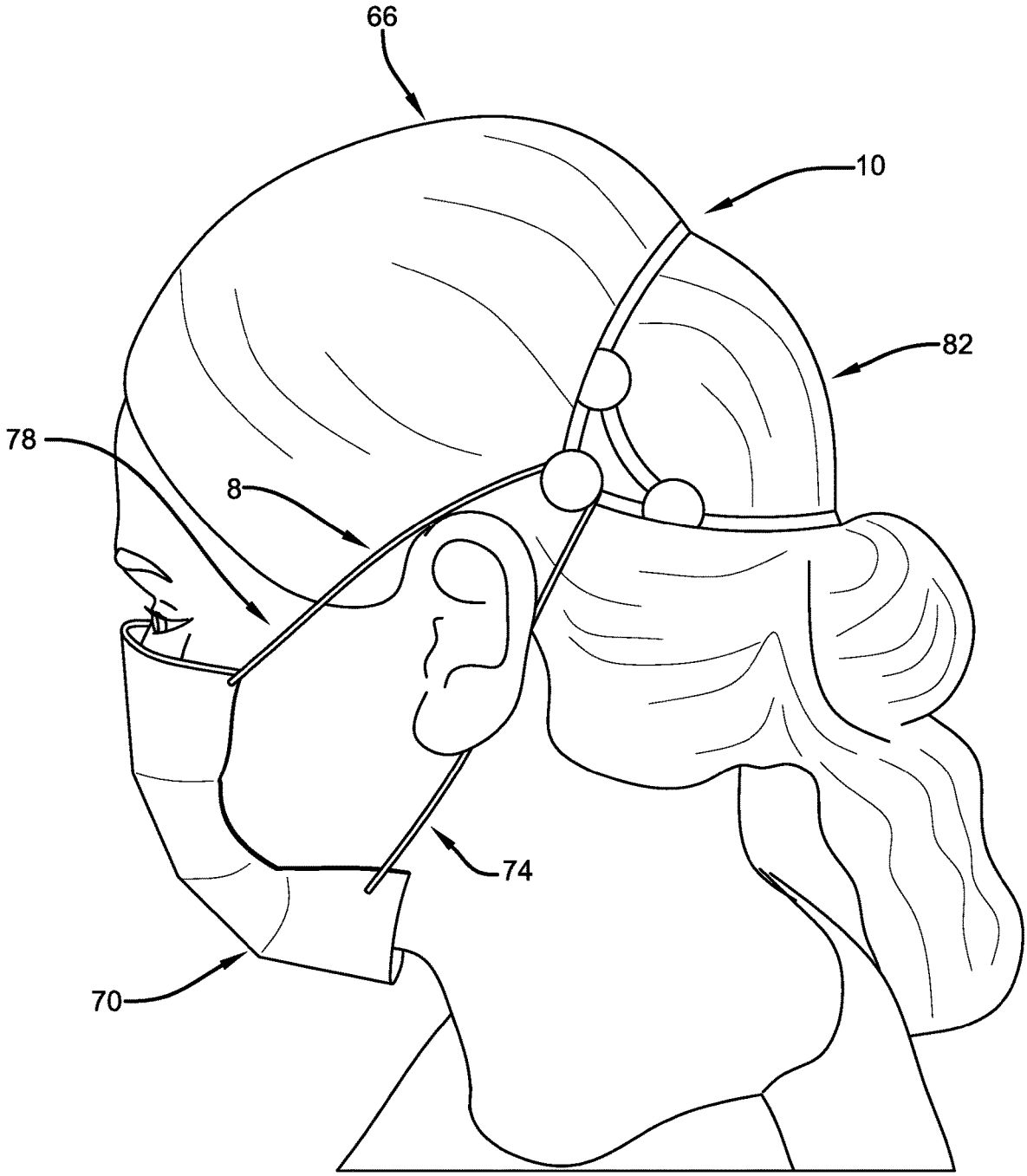
FIG. 5 is a view of the article 10 being worn by an associated user, showing the left side of the associated user's face, and showing an associated mask, and an associated loop of the mask.
Figure 6:
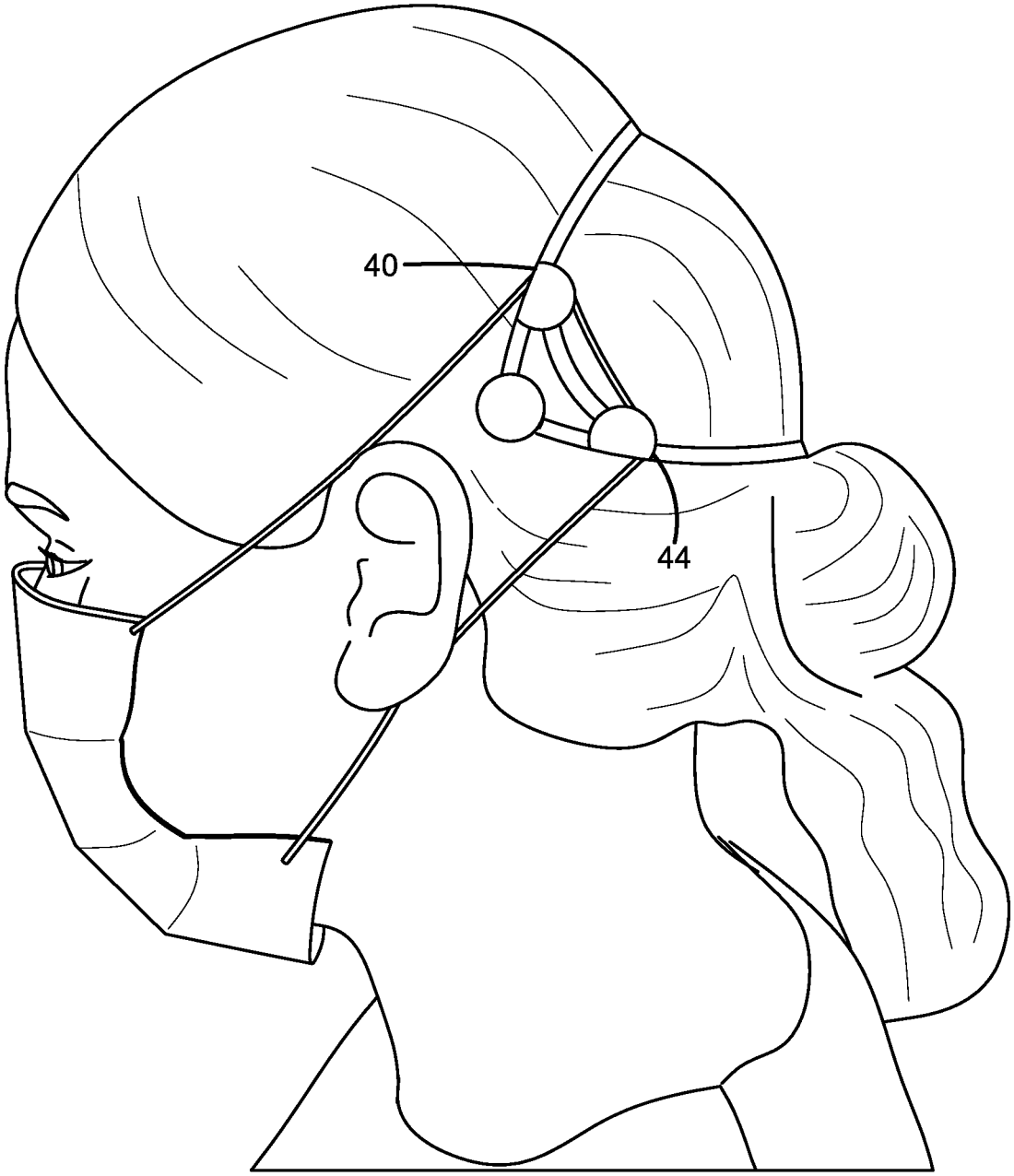
FIG. 6 is also a representation of the left side of an associated user's face wearing the article 10. But in this view, the associated loop of the mask is affixed to two different extensions of the article 10.
Figure 7:
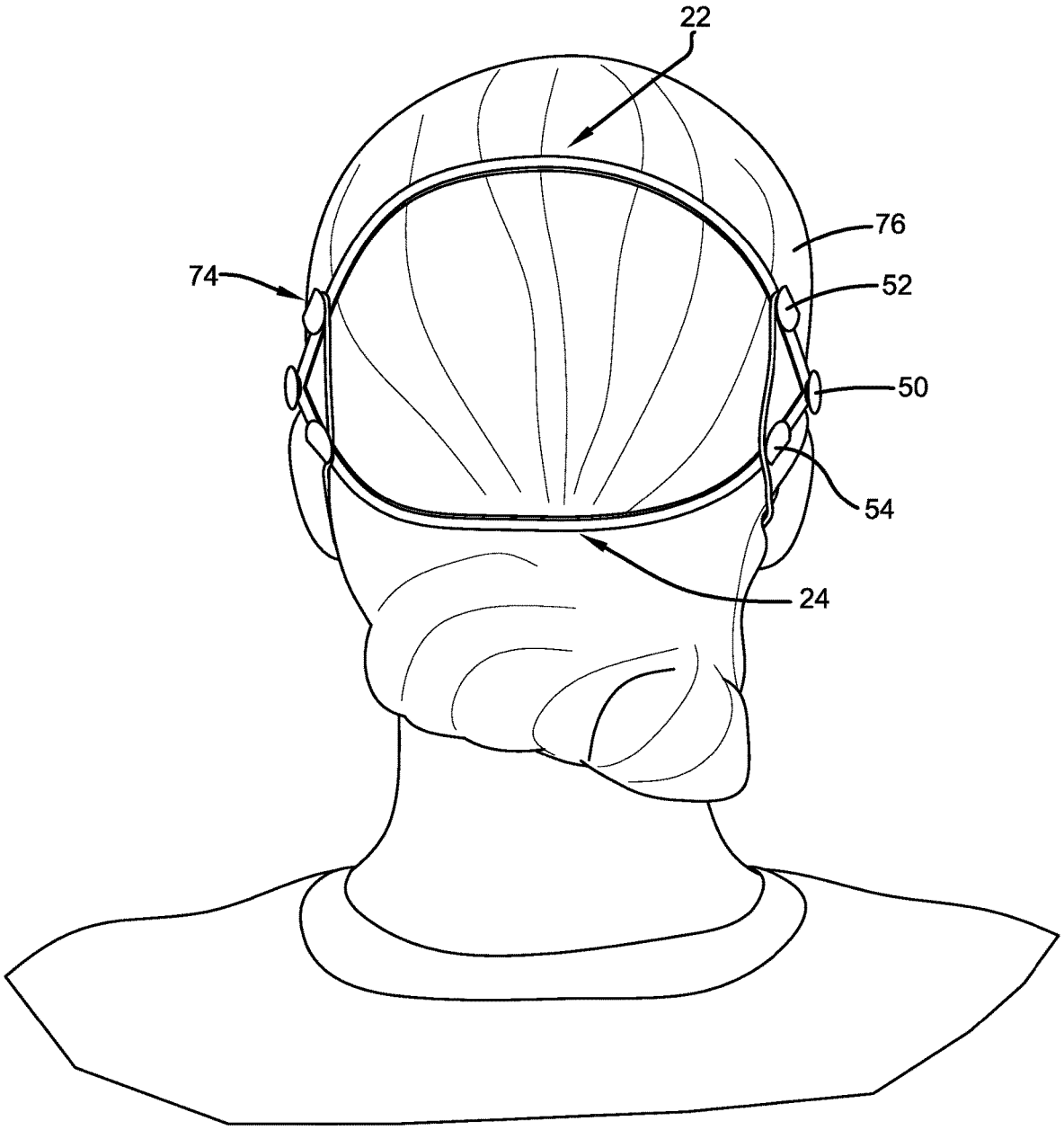
FIG. 7 is a rear view of the article 10 being worn by an associated user 66 with the loops 74, 76 of the associated mask 70 shown looped around extensions of the article.

With continued reference to FIGS. 5 and 6, the fit of the associated mask 70 can be adjusted by choosing a different extension 40, 42, 44, 50, 52, 54 or even a combination of extension. With reference to FIG. 6, the associated user 66 has chosen two extensions, namely 40, 44, about which to place the associated loop 74. This changes the angle of the loop and the manner in which it secures the associated mask 70 by pulling it against the user's mouth and nose.

Figure 8:
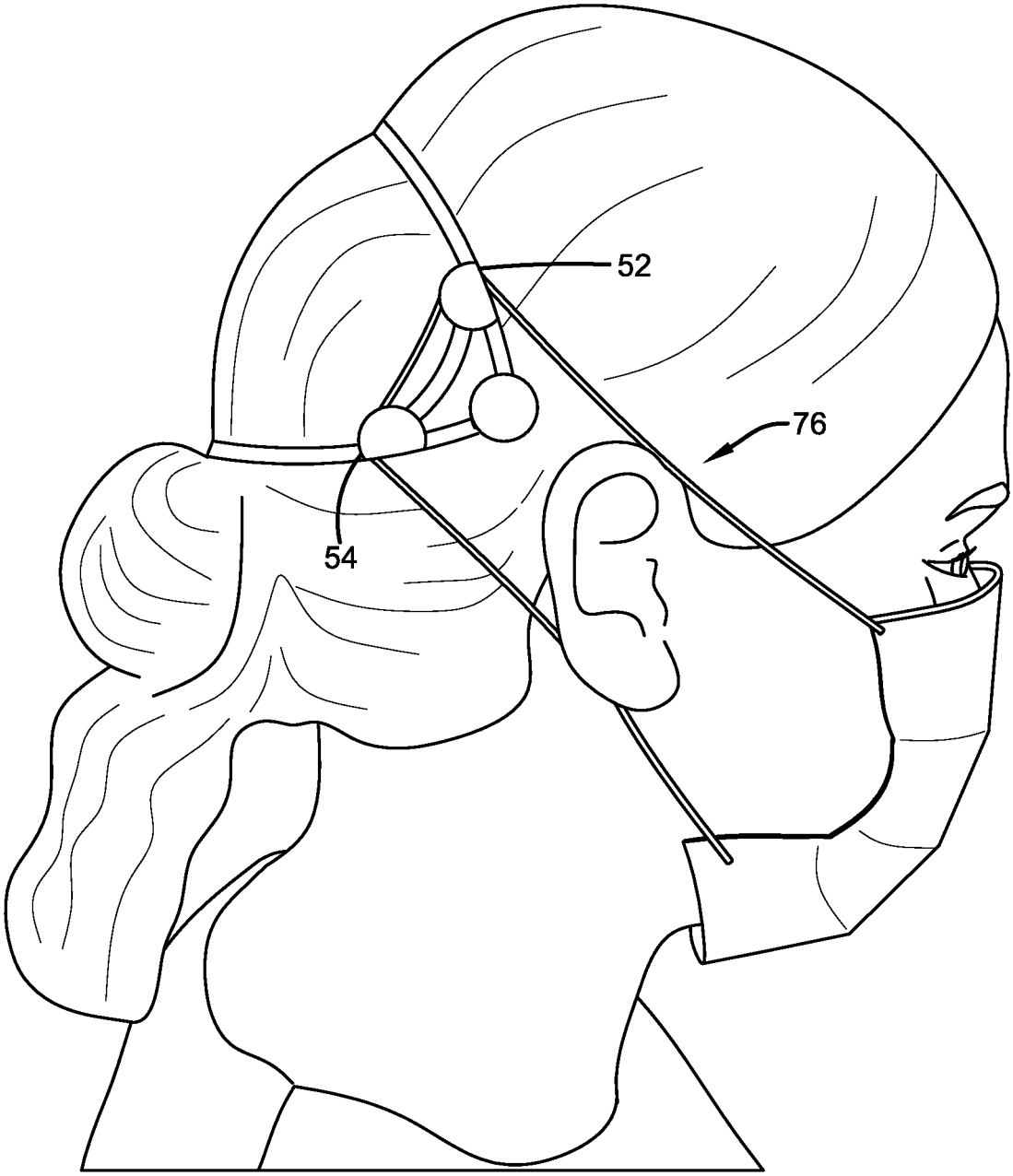
FIG. 8 is a view of the right side of an associated user's 66 face showing the associated loop 76 of the associated mask 70 looped around two extensions of the article and showing clearly how the loop is removed from the user's ear, thereby eliminating strain or discomfort on the user's ear.
Figure 9:
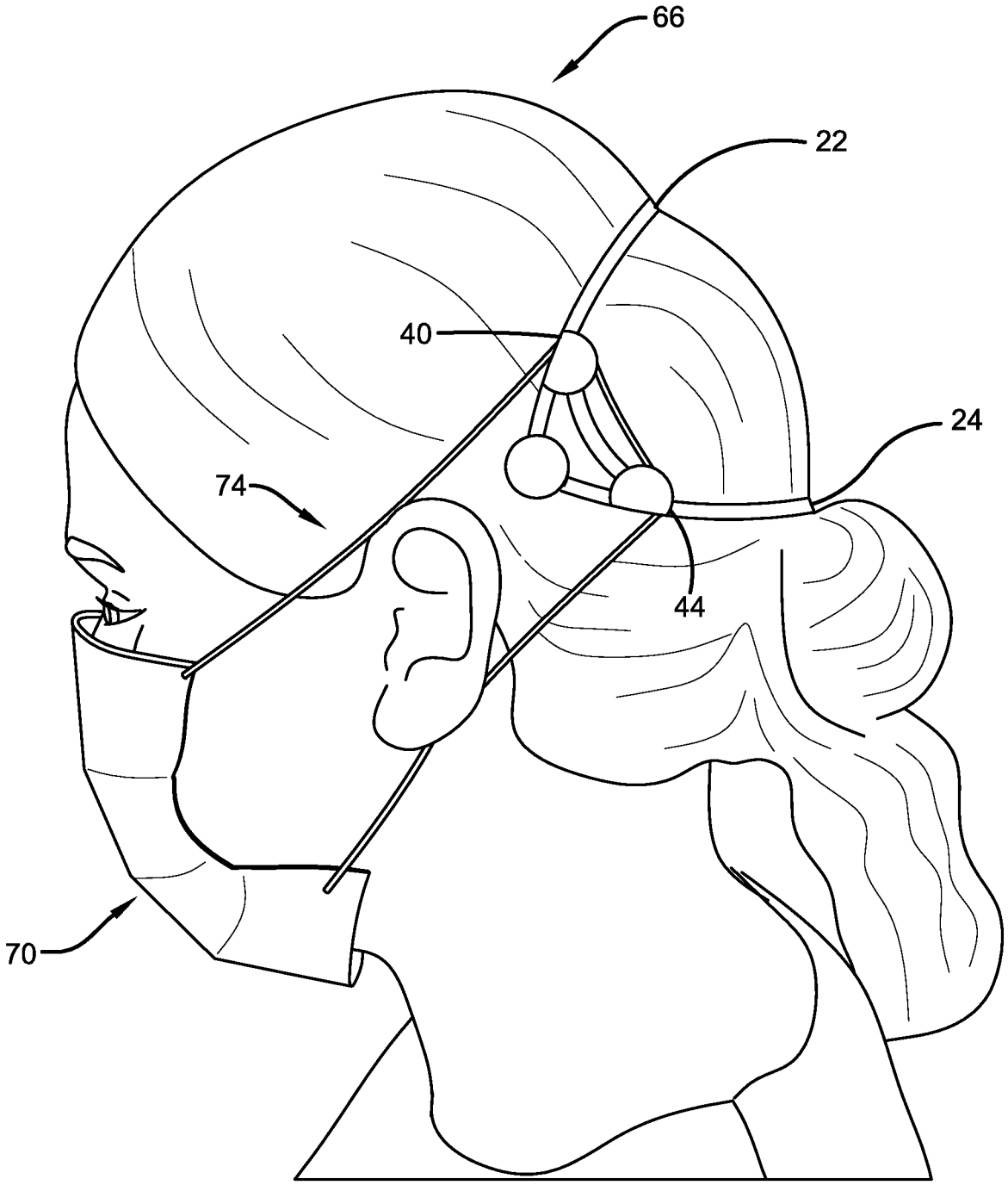
FIG. 9 is a view of the left side of an associated user's face showing an associated mask 70 in place with the loop of the mask oriented around two extensions of the article 10.
Figure 10:
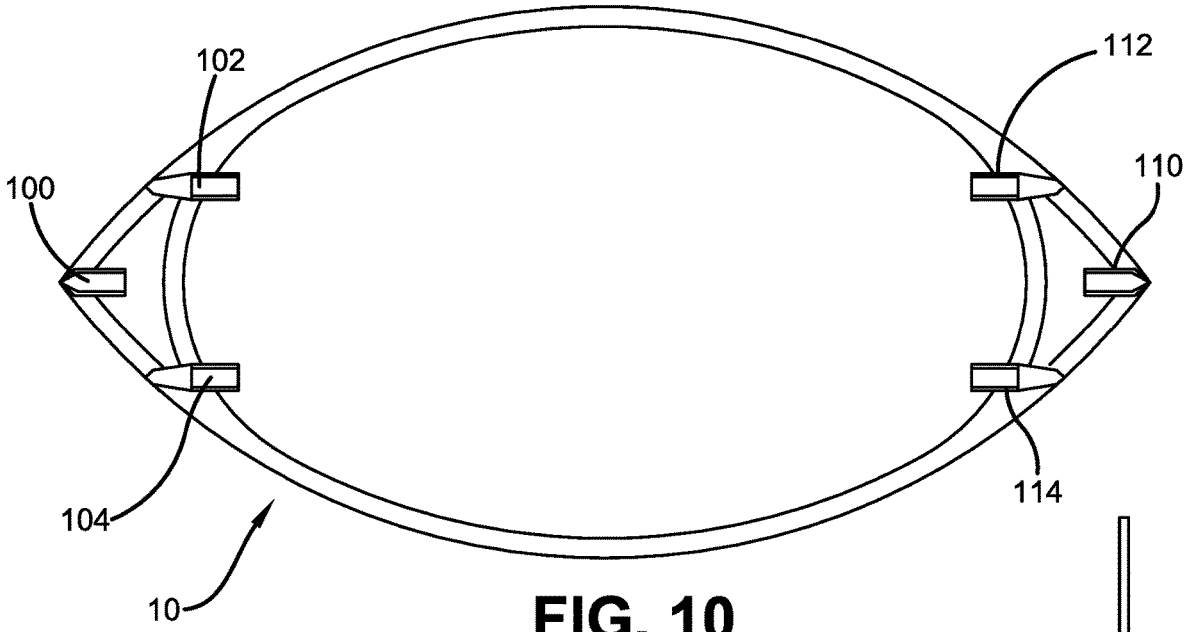
FIG. 10 is a top view of an alternate embodiment of the article.
Figure 11:
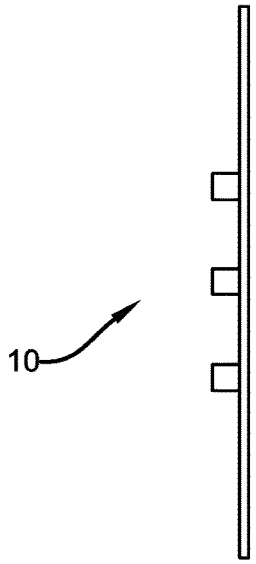
FIG. 11 is an end view of the alternate embodiment of the article which is shown in FIG. 10.
Figure 12:
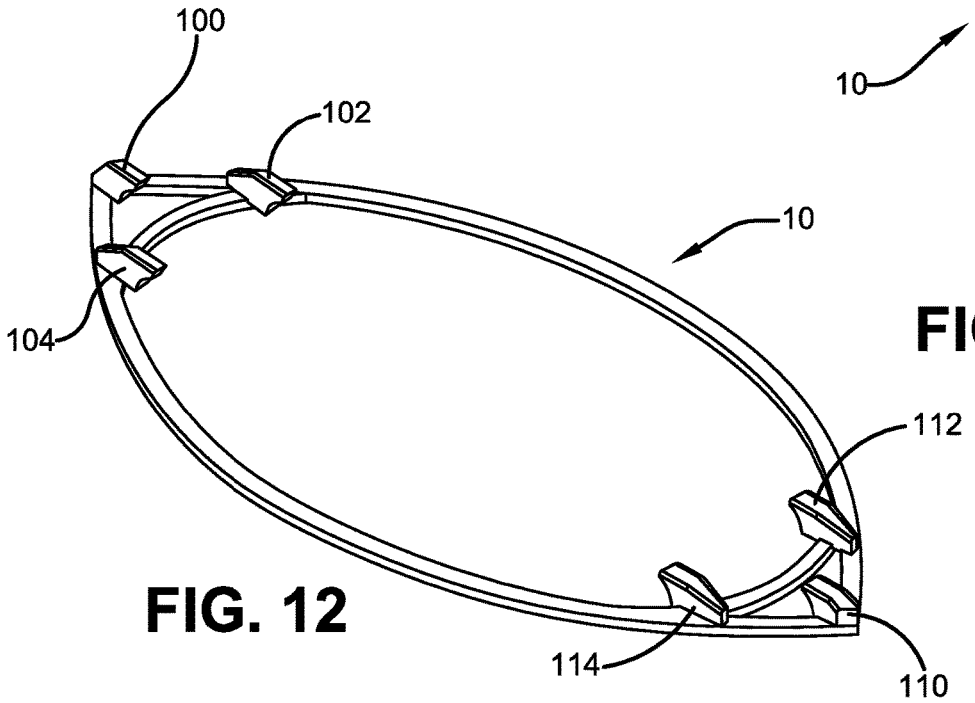
FIG. 12 is a perspective view of the alternate embodiment of the article which is shown in FIG. 10.

Similarly, with reference to FIGS. 8 and 9, another fit of the article 10 to the associated user 66 is shown, wherein this example, the associated loops 74 and its counterpart 76 are shown looped around extensions 52, 54, and 42, 44 respectively.

Figure 13:
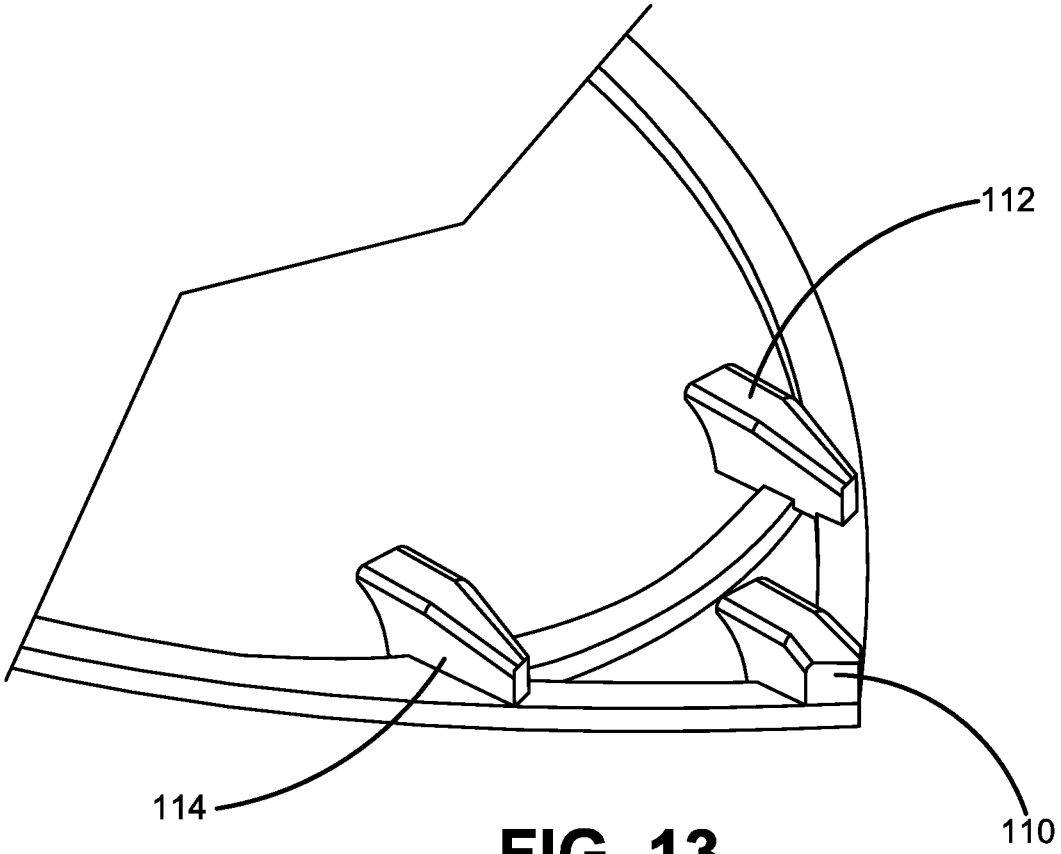
FIG. 13 is an enlarged view of alternate extensions as used in the alternate embodiment of the article which is shown in FIG. 10.
Figure 14:
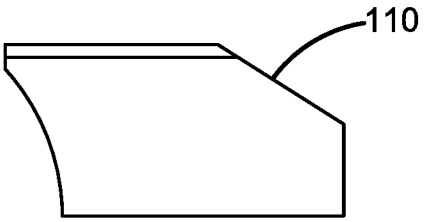
FIG. 14 is an enlarged, schematic view of an alternate extension as shown in FIG. 10.

With reference to FIGS. 10 through 14, an alternate embodiment of the invention will be described. While, extensions 40, 42 and 44 and extensions 50, 52 and 54 are shown in the FIGURES and described herein, an alternate embodiment of the extensions 100, 102 and 104 and 110, 112, and 114 are shown in FIGS. 10-14. In FIGS. 13 and 14, a close-up of the extensions the extensions 100, 102 and 104 and 110, 112, and 114 is shown. As is seen in FIGS. 13 and 14, an extension 110 has a specific angular configuration with flat surfaces which may be more easily manufactured than an extension with circular or conical surfaces.

We claim:

1. An article for securing a mask to an associated user's head, said article comprising:

a. a frame, said frame comprising a single piece of plastic configured into a generally oval shape, further comprising a first arc and a second arc extending between first and second ends of said article; said frame also comprising a first reinforcing member and a second reinforcing member; said first reinforcing member being located near said first end of said article and said second reinforcing member being located near said second end of said article; said frame having a top or outward side and an bottom or inward side of said frame, wherein normal operation said inward side of said frame fits against the associated back of the associated user's head; said frame having a first or horizontal axis and a second or vertical axis; said horizontal axis is generally horizontally oriented when said article is being worn in the article's intended manner by the associated user and said vertical axis is generally vertically oriented when said article is being worn in the article's intended manner by the associated user; said horizontal axis is longer than said vertical axis; said vertical axis being between 80 millimeters and 125 millimeters long; said horizontal axis being between 180 millimeters and 300 millimeters long; a ratio of said vertical axis to said horizontal axis is between 45% and 55%;

b. first, second, third, fourth, fifth and sixth extensions; said first, third and fourth extensions being located near said first end of said article; said second, fifth and sixth extensions being located near said second end of said article; said extensions extending outwardly from said outward surface of said article; said first and second extensions having a top or outward surface which is generally circular; said third, fourth, fifth and sixth extensions having a top or outward surface that primarily circular and which includes a straight edge; said extensions configured to selectively receive associated loops from an associated mask and to thereby secure the associated mask to the face of an associated user without the associated loops of the associated mask touching the associated ears of the associated user.

2. The article of claim 1, wherein the vertical axis is 106 millimeters and the horizontal axis is 212 millimeters.

3. The article of claim 1, wherein the ratio of said vertical axis to said horizontal axis is 50%.

4. A method of wearing a mask, said method comprising;

a. providing a mask with loops, the loops designed to fit behind the ears of an associated user;

b. providing an article, said article comprising a frame, said frame configured into a generally oval shape, further comprising a first arc and a second arc extending between first and second ends of said article; said frame having a top or outward side and an bottom or inward side of said frame, wherein normal operation said inward side of said frame fits against the associated back of the associated user's head; said frame having a first or horizontal axis and a second or vertical axis; said horizontal axis is generally horizontally oriented when said article is being worn in the article's intended manner by the associated user and said vertical axis is generally vertically oriented when said article is being worn in the article's intended manner by the associated user; said horizontal axis is longer than said vertical axis; said vertical axis being between 80 millimeters and 125 millimeters long, with the preferred length being 106 millimeters; said horizontal axis being between 180 millimeters and 300 millimeters long, with the preferred length being 212 millimeters; a ratio of said vertical axis to said horizontal axis is preferably between 45% and 55%, with the preferred ratio being 50%;

c. first, second, third, fourth, fifth and sixth extensions; said first, third and fourth extensions being located near said first end of said article; said second, fifth and sixth extensions being located near said second end of said article; said extensions extending outwardly from said outward surface of said article; said first and second extensions having a top or outward surface which is generally circular; said third, fourth, fifth and sixth extensions having a top or outward surface that primarily circular but which includes a straight edge; said extensions configured to selectively receive associated loops from an associated mask and to thereby secure the associated mask to the face of an associated user without the associated loops of the associated mask touching the associated ears of the associated user;

d. attaching a first loop of the associated mask to said first extension;

e. placing the associated mask onto the face of the associated user so that and inward surface of the frame fits against the back of the user's head; and, f. attaching a second loop of the associated mask to said second extension, thereby securing the mask to the user's face without the loops touching the user's ears.

5. An article for securing a mask to an associated user's head, said article comprising:

a. a frame, said frame comprising a single piece of plastic configured into a generally oval shape, further comprising a first arc and a second arc extending between first and second ends of said article; said frame having a first or horizontal axis and a second or vertical axis; said horizontal axis is generally horizontally oriented when said article is being worn in the article's intended manner by the associated user and said vertical axis is generally vertically oriented when said article is being worn in the article's intended manner by the associated user; said horizontal axis is longer than said vertical axis; said vertical axis being between 80 millimeters and 125 millimeters long, with the preferred length being 106 millimeters; said horizontal axis being between 180 millimeters and 300 millimeters long, with the preferred length being 212 millimeters;

b. first and second extensions; said first and second extensions extending outwardly from said outward surface of said article, wherein said first extension is positioned at a point where a reinforcing member adjoins the first arc, said second extension positioned at a point where the reinforcing member adjoins the second arc, and said first and second extensions being positioned in such manner at the first and second ends of said article; said first and second extensions having a top or outward surface which is generally circular; said extensions configured to selectively receive associated loops from an associated mask and to thereby secure the associated mask to the face of an associated user without the associated loops of the associated mask touching the associated ears of the associated user.

* * * * *